US005224910A

United States Patent [19]

Deutsch

[11] Patent Number: 5,224,910

[45] Date of Patent: Jul. 6, 1993

[54] JUMP ROPE AND HANDLES THEREFOR

[75] Inventor: Victor J. Deutsch, Surfside, Fla.

[73] Assignee: Deutsch Technology Corp., Fla.

[21] Appl. No.: 919,038

[22] Filed: Jul. 24, 1992

[51] Int. Cl.[5] ..... A63B 5/20

[52] U.S. Cl. ..... 482/82; 482/49; 482/139

[58] Field of Search ..... 482/82, 49, 139; 434/112, 113, 116; 273/DIG. 27

[56] References Cited

U.S. PATENT DOCUMENTS 4,018,441 4/1977 Greenberg .
4,090,705 5/1978 Young .
4,101,123 7/1978 Anthony .
4,136,866 1/1979 Bouvier .
4,293,125 10/1981 Hinds .
4,330,118 5/1982 Race .
4,489,934 12/1984 Miller .
4,529,193 7/1985 Kuhnsman .
4,714,245 12/1987 Cho .
4,776,585 10/1988 Maleyko et al. .
4,778,173 10/1988 Joutras .
4,787,624 11/1988 Grant .
4,801,137 1/1989 Douglass .
4,872,666 10/1989 Smith .

*Primary Examiner*—Richard J. Apley
*Assistant Examiner*—Lynne A. Reichard
*Attorney, Agent, or Firm*—Anthony J. Casella; Gerald E. Hespos

[57] ABSTRACT

A jump rope is provided to facilitate easier use by people with visual or neurological impairments. The jump rope includes at least one handle having the rope rotatably mounted therein. The handle further includes at least one detector for identifying the rotational orientation of the jump rope relative to the handle. The detector can move outwardly and into contact with the hand of the person using the jump rope so that the person achieves non-visual indication of the position of the rope relative to the handle.

15 Claims, 3 Drawing Sheets

JUMP ROPE AND HANDLES THEREFOR

BACKGROUND OF THE INVENTION

Jumping rope is an exceptional aerobic exercise that enhances the tone of many muscle groups and that contributes to coordination and agility. Unlike many other exercises and sporting activities, jumping rope requires a very low initial capital expense and only a minimum amount of space. Furthermore, jumping rope normally creates few risks of injury. The benefits of jumping rope can be enjoyed by virtually all age groups and all athletic abilities. Young children and professional prize fighters are among the many people who routinely jump rope.

The well documented benefits of physical activity apply to both handicapped people and people substantially free of handicaps. However, handicaps often severely limit the range of physical activities that people can partake in. For example, visually impaired people often cannot jog or partake in sporting activities that require running. Jumping rope also can be difficult for a blind or visually impaired person in view of difficulties in determining precisely where the rope is so that a jump can be timed. People with neurological disabilities or learning disabilities also have problems in many sporting activities that require hand-eye coordination. Jumping rope is one such activity that can be difficult to people with neurological disabilities or learning disabilities in view of the hand-eye coordination required to time each jump. An innate lack of coordination without a specific neurological cause also can make jumping rope difficult. Thus, people having handicaps and people who are merely uncoordinated typically will not jump rope despite the many low-cost benefits that can be achieved from jumping rope.

The simplest jump rope merely consists of an elongated length of flexible material that can be held in the hands of the exerciser. Other jump rope include handles rigidly mounted to the opposed ends of the rope such that the rope can repeatedly pivot about the ends that are fixedly mounted in the handles. Better jump ropes, however, are rotatably mounted in the handles by an array of bearings or the like. Even good prior art jump ropes, however, will not make jumping rope easier for people who are handicapped or uncoordinated as described above.

In view of the above, it is an object of the subject invention to provide a jump rope that can be efficiently used by people with handicaps.

Another object of the subject invention is to provide a jump rope that is particularly useful for people with visual impairments and/or neurological disabilities.

A further object of the subject invention is to provide a jump rope that is well suited to people with poor hand-eye coordination.

SUMMARY OF THE INVENTION

The subject invention is directed to a jump rope having at least one handle comprising a generally hollow body dimensioned and configured to be easily gripped by the hand of a person employing the jump rope. The handle includes means for rotatably retaining an end of the jump rope therein The handle further includes means for providing sensory indication of the rotational orientation of the jump rope relative to the handle. The sensory indication may be a tactile sensory indication, and may be defined by periodic contact with the hand of the user such that the contact indicates the rotational orientation of the jump rope. Thus, a user of the jump rope who has a visual impairment and/or a neurological impairment or one who merely has below average muscular coordination can receive additional sensory stimuli identify the approximate location of the spinning rope. The additional stimuli can help the user of the jump rope to properly time jumps relative to the spinning rope despite an inability to properly see the rope or an inability to neurologically appreciate the visual observations pertaining to the position of the rope.

The means for rotatably retaining the rope in the handle may comprise a generally tubular sleeve into which an end of the rope is inserted. The sleeve may include a mounting portion rotatably mounted to bearings in the body of the handle. The sleeve may further include a guiding portion disposed exteriorly of the body of the handle. The guiding portion of the sleeve may be angularly aligned relative to the mounting portion thereof. Thus, the sleeve provides a definite directional orientation of the rope relative to the body of the handle.

The means for providing sensory indication of the rotational orientation of the jump rope may comprise a cam non-rotatably mounted around the portion of the rope disposed in the handle. For example, the cam may be rigidly mounted to portions of the sleeve disposed within the body of the handle. Thus, the cam may rotate with the sleeve and/or with the jump rope.

The means for providing sensory indication of rotational orientation of the jump rope may further comprise at least one indicator having an inner end slidably engaged with the cam and an outer end projecting away from the cam and non-rotatably disposed relative to the body of the handle. The indicator and the cam may be dimensioned such that selected rotational orientations of the cam urge the indicator outwardly relative to the body to provide indication of the rotational orientation of the jump rope. More particularly, the body may have at least one aperture passing therethrough, and the indicator may be slidably disposed in the aperture. Thus, the sliding contact between the cam and the inner end of the indicator will periodically urge the indicator outwardly in the aperture of the body. The indicator may be dimensioned such that the outer end thereof is disposed exteriorly of the body of the handle during at least selected rotational orientations of the cam and the jump rope. This movement of the indicator exteriorly of the handle can be sensed by the hand of the user to provide the tactile indication of the rotational orientation of the jump rope. The means for providing indication of the rotational orientation may further comprise biasing means for urging the indicator inwardly and against the cam. However, at selected rotational orientations, the cam will urge the indicator outwardly and against the forces exerted by the biasing means.

In preferred embodiments, as explained further herein, a plurality of indicators are disposed at selected circumferential positions about the handle. Each such indicator will have an inner end slidably disposed in contact with the cam. Thus, the user of the jump rope will sequentially receive tactile sensory stimuli indicating the relative position of the rope as the rope spins about relative to the handle.

DETAILED DESCRIPTION OF THE PREFERRED EMBODIMENT

Figure 1:
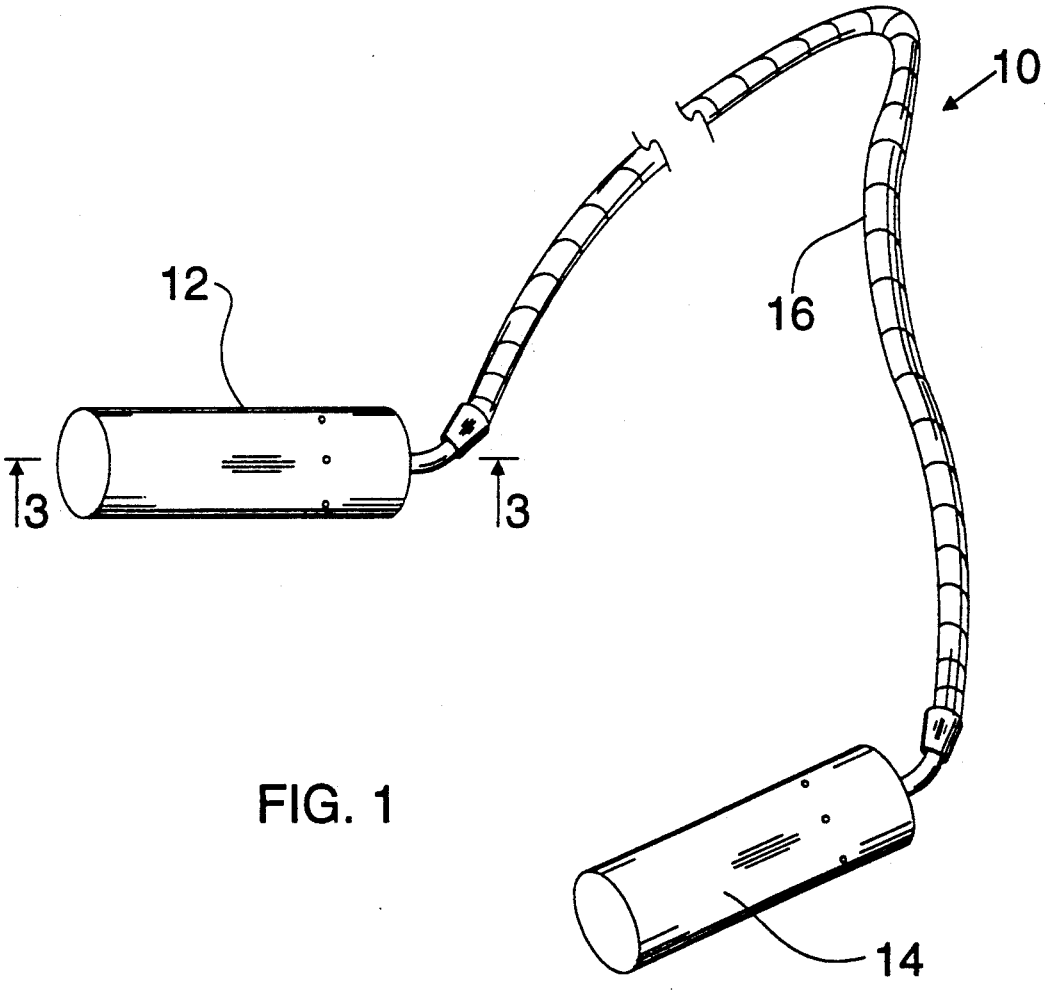
FIG. 1 is a perspective view of a jump rope in accordance with the subject invention.

A jump rope in accordance with the subject invention is identified generally by the numeral 10 in FIG. 1. The jump rope 10 includes a pair of handles 12 and 14 and an elongated flexible rope 16 extending therebetween. The handles 12 and 14 are illustrated as being substantially identical to one another. However, such identity is not absolutely necessary.

Figure 2:
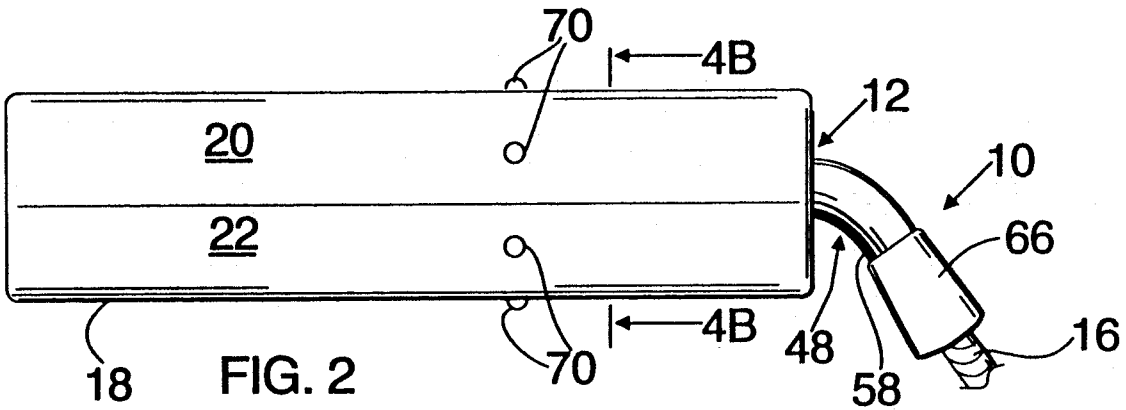
FIG. 2 is a side elevational view of the jump rope handle depicted in FIG. 1.
Figure 3:
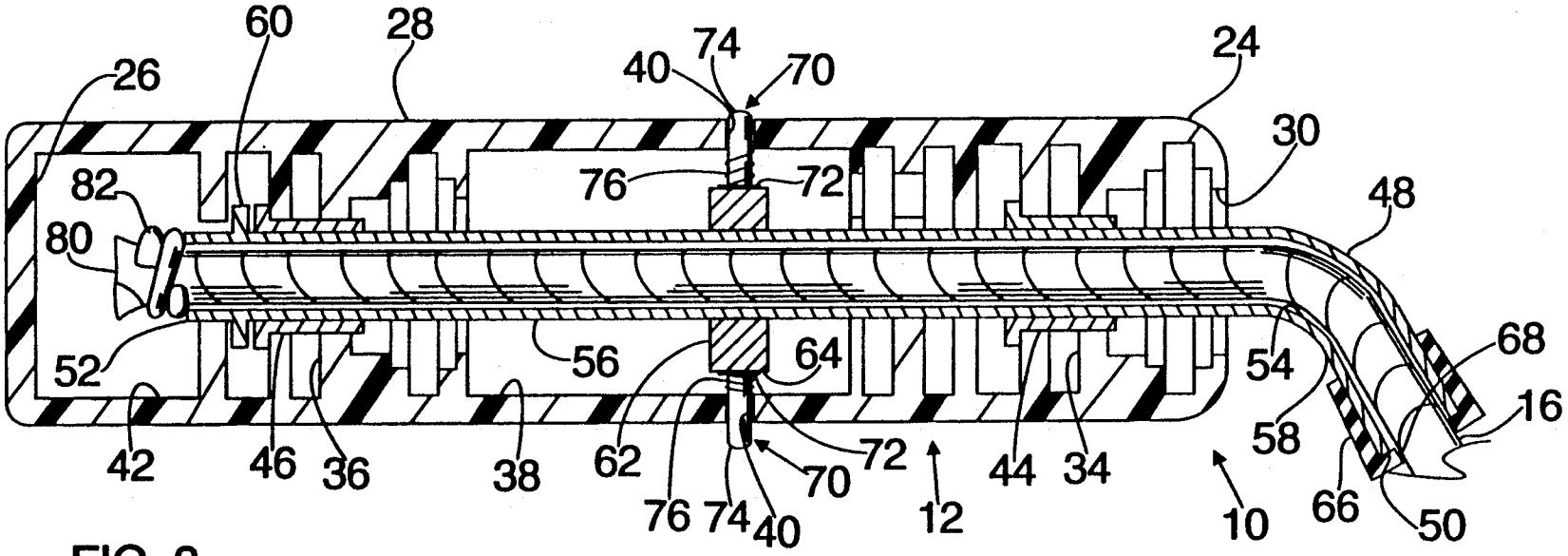
FIG. 3 is a cross-sectional view taken along line 3—3 in FIG. 1A.

As shown more clearly in FIGS. 2 and 3, the handle 12 includes a generally cylindrical body 18 formed from opposed generally semi-cylindrical halves 20 and 22 respectively. The halves 20 and 22 are injection molded from a thermoplastic material such as polypropylene or ABS, and are held together by a suitable adhesive or a mechanical fastening means. It is to be understood, however, that other handle materials may be employed, such as wood, metal or fiberglass. The body 18 of the handle 12 includes a front end 24, an opposed rear end 26 and a generally cylindrical side wall 28 extending therebetween. The front end 24 is characterized by a front aperture 30 extending into a generally hollow interior of the body 18. More particularly, the interior of the body 18 includes front and rear bearing supports 34 and 36 respectively disposed generally in proximity to the front and rear ends 24 and 26 of the body 18. A cam chamber 38 is defined in the body 18 intermediate the front and rear bearing supports 34 and 36. A plurality of generally radially aligned apertures 40 extend through the cylindrical side wall 28 of the body 18, for connecting the cam chamber 38 to the exterior of the handle 12. As shown most clearly in FIGS. 4A–6B, a total of six radially aligned apertures 40 are spaced from one another by approximately 60° about the circumference of the body 18. A rope end chamber 42 also is defined in the body 18 intermediate the rear bearing support 36 and the rear end 26 of the body 18. Front and rear bearings 44 and 46 respectively are mounted in the front and rear bearing supports 34 and 36 of the body 18.

The handle 12 further includes a sleeve 48 formed from a generally rigid tubular material. The sleeve 48 includes opposed front and rear ends 50 and 52 and a generally cylindrical passageway 54 extending therebetween. The cylindrical passageway 54 in the sleeve 48 is cross-sectionally dimensioned to receive an end of the rope 16 therein. The sleeve 48 includes a generally cylindrical mounting portion 56 extending forwardly from the rear end 52 of the sleeve 48 and a guiding portion 58 extending rearwardly from the front end 50 of the sleeve 48. The guiding portion 58 of the sleeve 48 is angularly aligned to the mounting portion 56 such that the guiding and mounting portions 56 and 58 intersect one another at approximately 135°. The mounting portion 56 of the sleeve 48, extends from the rope-end chamber 42 in the hollow body 18 toward and through the aperture 30 in the front end 24 of the body 18. Hence, the mounting portion 56 is rotatably supported in the front and rear bearings 44 and 46 respectively.

A washer 60 is fixedly secured to the mounting portion 56 of the sleeve 48 at a location between the end 52 thereof and the rear bearing 46. The washer 60 is operative to prevent removal of the sleeve 48 from the body 18 of the handle 12.

A cam 62 is non-rotatably secured about the mounting portion 56 of the sleeve 48 at a location within the cam chamber 38 substantially aligned with the apertures 40 through the side wall 28 of the body 18. As shown most clearly in FIGS. 4B, 5B and 6B, the cam defines a non-cylindrical exterior surface having an actuating region 64 thereon defining the major radially dimension for the cam 62. The cam 62 is rotationally aligned on the mounting portion 56 of the sleeve 48 such that the actuating region 64 is aligned with the guiding portion 58 of the sleeve 48.

The guiding portion 58 of the sleeve 48 is disposed exteriorly of the body 18, and hence could be contacted by the hand of a person using the jump rope 10. As a result, a protective cap 66 formed from an elastomeric material is mounted over the front end 50 of the sleeve 48. An aperture 68 extends through the protective cap 66 and is dimensioned to slidably receive the rope 16 therethrough.

The handle 12 further includes a plurality of indicators 70 slidably mounted respectively in the apertures 40 through the cylindrical side wall 28 of the body 18. Each indicator 70 includes an inner end 72 defining a cross-sectional dimension larger than the cross-sectional dimension of the corresponding aperture 40 through the cylindrical side wall 28 of the body 18. Thus, the indicators 70 will not fall completely out of the handle 12. The inner end 72 of each indicator 70 is in sliding engagement with the cam 62. Each indicator 70 further include a radially outer end 74 which extends through the corresponding aperture 40 to a location that is approximately at or slightly beyond the outer circumferential surface of the cylindrical side wall 28. Coil springs 76 surround the portions of each indicator 70 within the cam chamber 38 of the body 18. The coil springs 76 are operative to bias the detectors 70 radially inwardly and against the cam 62.

The rope 16 includes an end 80 which is passed through the aperture 68 in the protective cap 66 and entirely through the interior 54 of the sleeve 48. Thus, as shown most clearly in FIG. 3, the end 80 of the rope 16 extends into the rope-end chamber 42 of the body 18 of the handle 12. A retaining wire 82 is crimped onto the rope 16 in proximity to the end 80. The rope 16, with the retaining wire 82 thereon, defines a cross-sectional dimension greater than the diameter of the interior 54 of the sleeve 48. Hence, withdrawal of the rope 16 from the sleeve 48 is prevented. Other retention means also could be provided.

The jump rope 10 of the subject invention can be used with substantially the same hand and arm movements as a conventional jump rope. These movements will cause the mounting portion 56 of the sleeve 48 to rotate within the body 18 of the handle 12, while the guiding portion 58 of the sleeve 48 and portions of the rope 16 between the handles 12 and 14 will rotate about the handles 12 and 14.

Figures 4A, 4B, 5A, 5B, 6A, 6B:
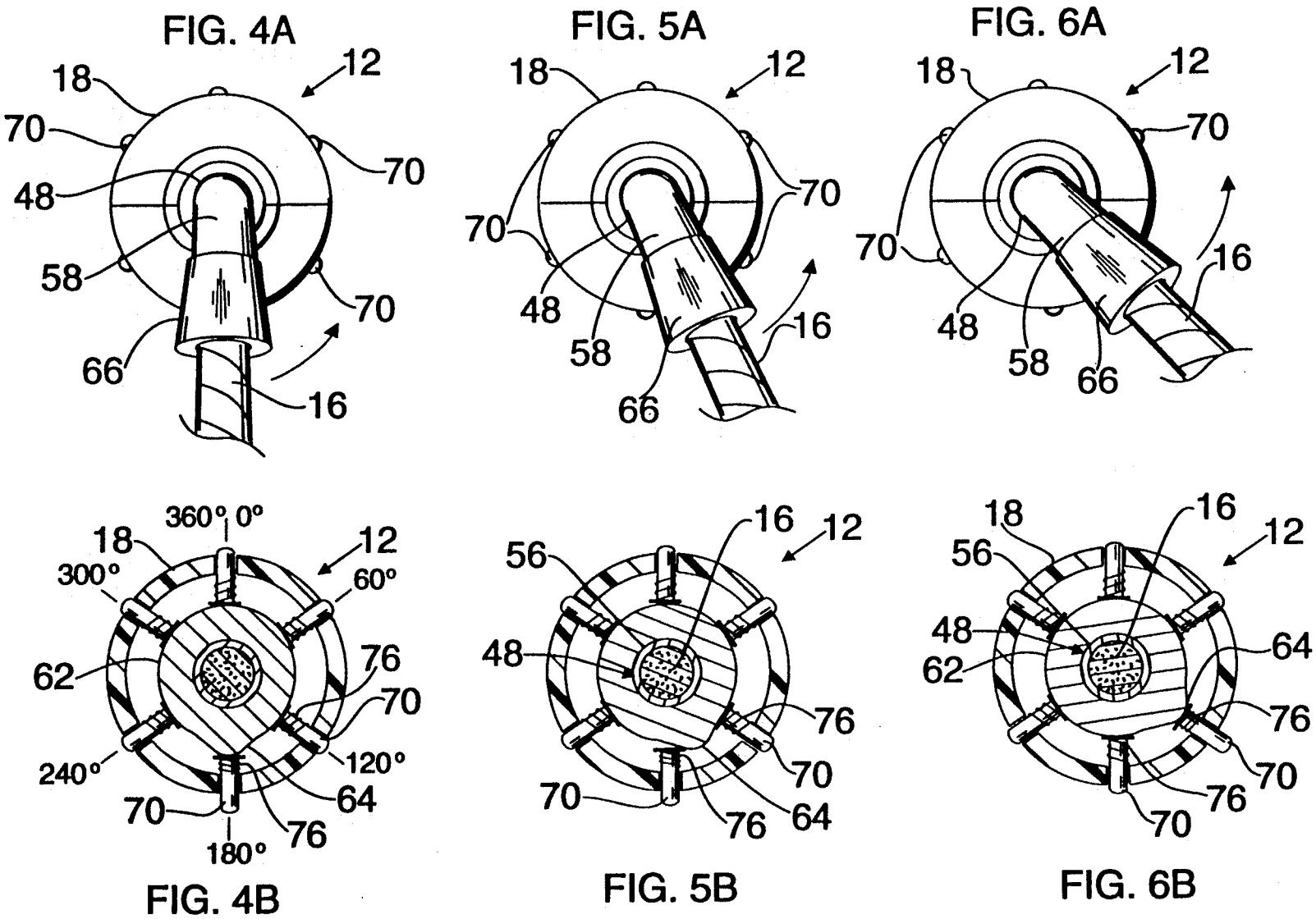
FIG. 4A is an end elevational view of the jump rope handle shown in FIG. 1.
FIG. 4B is a cross-section taken along line 4*b*—4*b* in FIG. 2.
FIG. 5A is a end elevational view similar to FIG. 4A, but showing the jump rope in a second rotational position.
FIG. 5B is a cross-sectional view similar to FIG. 4B, but corresponding to the rotational position of the rope shown in FIG. 5A.
FIG. 6A is an end elevational view similar to FIGS. 4A and 5A, but showing the rope in a third rotational orientation.
FIG. 6B is a cross-sectional view similar to FIGS. 4B and 5B, but corresponding to the rotational orientation of the rope shown in FIG. 6A.

The cam 62 will rotate with the mounting portion 56 of the sleeve 48. This rotation of the cam 62, as shown most clearly in FIGS. 4B, 5B and 6B will cause the actuating region 64 of the cam 62 to sequentially contact the detectors 70. As noted above, the actuator region 64 of the cam 62 defines a major radially dimension on the cam 62, and hence will urge the detector 70 that is in contact with the actuating region 64 radially outwardly. Thus, as the cam 62 rotates, the detectors 70 disposed at spaced apart circumferential positions about the handle 12 will sequentially be urged radially outwardly. The detector 70 that are not engaged by the actuating region 64 of the ca 62 will be urged radially inwardly by the springs 76. This sequential outward movement of the detectors 70, as shown in FIGS. 4B, 5B and 6B is sufficiently great to be readily detected by the hand of the person using the jump rope 10.

As noted above, the actuating region 64 of the cam 62 is radially aligned with the guide portion 58 the sleeve 48. Additionally, the guide portion 58 of the sleeve 48 effectively defines the location of the rope 16. Thus, the particular detector 70 that is urged outwardly by the actuating region 64 of the cam 62 will provide an accurate tactile indication of the rotational location of the rope 16 relative to the handles 12 and 14. This tactile indication operates as a substantial aid to a visually impaired person, a neurologically impaired person or a person with low coordination skills for identifying the relative position of the rope 16. The tactile indication can be used in place of or in addition to a visual indication to help the person using the jump rope 10 to know when to time their jump.

In summary, a jump rope is provided including a rope and a pair of handles. At least one of the handles is provided with at least one detector for identifying the rotational orientation of the rope relative to the handle. The indicator may include a detector extending generally radially through the handle a sufficient amount to be detected by the hand of the person using the jump rope. The detector may be urged outwardly by a cam that is mounted in the handle and that is rotatable with the jump rope. Thus, tactile sensory impulses delivered to the hand of the person using the jump rope provide positive indication of the location of the rope relative to the handles and the hands of the person using the jump rope.

While the invention has been described with respect to a preferred embodiment, it will be appreciated that various changes can be made without departing from the scope of the invention as defined by the appended claims. For example, the number and location of detectors for providing indication of the rotational orientation of the jump rope can be varied from the preferred embodiments shown herein. Similarly, the location and arrangement of bearings can be varied from the illustrated embodiment. Still further, the means for preventing withdrawal of the sleeve from the handle, and the means for preventing withdrawal of the rope from the sleeve also can be varied from the particular illustrated embodiment herein.

I claim:

1. A jump rope handle comprising a generally hollow body, means for rotatably retaining an end of the jump rope in a body, and means mounted in said handle for providing tactile indication of the rotational orientation of the jump rope relative to the handle.

2. A jump rope handle as in claim 1, wherein the means for rotatably retaining an end of the jump rope comprises at least one bearing mounted in the body and a generally tubular sleeve fixedly engaged over the end of the jump rope, said sleeve including a mounting portion rotatably mounted to the bearing.

3. A jump rope handle as in claim 2, wherein the sleeve further includes a guiding portion angularly aligned to the mounting portion and disposed external of the body, the jump rope being engaged by the guiding portion such that the rotational orientation of the guiding portion corresponds to the rotational orientation of the jump rope.

4. A jump rope handle as in claim 1 wherein the means for providing tactile indication of rotational orientation of the jump rope comprises: a cam rigidly mounted around the end of the jump rope and rotatable therewith; and at least one indicator having an inner end slidably engaged with the cam and an outer end projecting away from the cam and non-rotatably disposed relative to the body, said cam and said indicator being dimensioned such that selected rotational orientations of the cam urge the indicator outwardly relative to the body for providing the indication of the rotational orientation of the jump rope.

5. A jump rope handle as in claim 4, wherein the body has at least one aperture passing therethrough, the indicator being slidably mounted in the aperture.

6. A jump rope handle as in claim 5, further comprising biasing means for urging the inner end of the indicator against the cam.

7. A jump rope handle as in claim 4, comprising a plurality of said indicators, said cam sequentially urging selected ones of said indicators outwardly.

8. A jump rope handle as in claim 7, wherein the indicators are substantially equally angularly spaced around the body of the handle.

9. A jump rope handle as in claim 4, wherein the cam includes an actuating region defining a major radially dimension of the cam, the actuating region of the cam being radially aligned with the guiding portion of the sleeve.

10. A jump rope comprising a flexible rope having opposed longitudinal ends, a pair of handles mounted respectively to the ends of the flexible rope, at least one said handle comprising a hollow body, means for rotatably retaining one said end of the rope in the body of the handle and means mounted in said handle for providing tactile indication of the rotational orientation of the rope relative to the handle.

11. A jump rope as in claim 10, wherein the means for rotatably retaining an end of the rope in the body comprises a pair of bearings mounted in the body and a sleeve fixedly engaged over the end of the rope, said sleeve including a mounting portion rotatably mounted in the bearings and a guiding portion angularly aligned to the mounting portion and disposed external of the body.

12. A jump rope as in claim 11, wherein the means for providing tactile indication of rotational orientation of the rope comprises a cam rigidly mounted over the mounting portion of the sleeve, said cam having an actuating region defining a major radius, the actuating region being radially aligned with the guiding portion of the sleeve, at least one indicator having an inner end slidably engaged with the cam and an outer end projecting away from the cam, the indicator being non-rotatably disposed relative to the housing, said cam and said indicator being dimensioned such that selected rotational orientations of the cam and the guide portion of the sleeve urge the indicator outwardly relative to the body of the handle for providing indication of rotational orientation of the rope relative to the handle.

13. A jump rope as in claim 12, further comprising biasing means for urging the inner end of the indicator against the cam.

14. A jump rope as in claim 13, comprising six indicators equally spaced around the handle.

15. A jump rope comprising a flexible rope having opposed longitudinal ends, a pair of handles mounted respectively to the ends of the flexible rope, at least one said handle comprising a substantially hollow generally cylindrical plastic body, said body being formed with a plurality of apertures extending therethrough at a selected longitudinal position along the generally cylindrical body, at least one bearing mounted in the body, a sleeve fixedly engaged over the end of the flexible rope, said sleeve including a mounting portion rotatably mounted in the bearing of the body and a guiding portion angularly aligned to the mounting portion and disposed external of the body, a cam rigidly mounted over the mounting portion of the sleeve at a location for alignment with the apertures through the body of the handle, said cam having an actuating region thereon defining a major radius, the actuating region of the cam being aligned with the guiding portion of the sleeve, a plurality of radially aligned indicators slidably disposed in the respective apertures of the body, each said indicator having an inner end in sliding contact with the cam and an opposed outer end projecting from the body of the handle in selected rotational alignments of the cam, whereby the cam rotates with the sleeve and the jump rope relative to the handle, and whereby the indicators sequentially move radially outwardly in response to rotation of the actuating region of the cam for providing tactile indication of orientation of the rope.

* * * * *